US005585037A

United States Patent [19]

Linton

[11] Patent Number: 5,585,037

[45] Date of Patent: Dec. 17, 1996

[54] ELECTROCONDUCTIVE COMPOSITION AND PROCESS OF PREPARATION

[75] Inventor: Howard R. Linton, Wilmington, Del.

[73] Assignee: E. I. Du Pont de Nemours and Company, Wilmington, Del.

[21] Appl. No.: 386,765

[22] Filed: Aug. 2, 1989

[51] Int. Cl.[6] ..... H01B 1/00; H01B 1/08

[52] U.S. Cl. ..... 252/518; 252/521; 106/415; 106/482; 106/483; 428/363; 428/403

[58] Field of Search ..... 252/518, 521; 106/415, 482, 483, 903; 428/363, 403

[56] References Cited

U.S. PATENT DOCUMENTS

| | | | |
|---|---|---|---|
| 2,885,366 | 5/1959 | Iler | 252/313 |
| 4,373,013 | 2/1983 | Yoshizumi | 428/370 |
| 4,431,764 | 2/1984 | Yoshizumi | 524/409 |
| 4,452,830 | 6/1984 | Yoshizumi | 427/215 |
| 4,568,609 | 2/1986 | Sato et al. | 428/403 |
| 4,917,952 | 4/1990 | Katamoto et al. | 252/519 |
| 5,071,676 | 12/1991 | Jacobson | 252/518 |
| 5,104,583 | 4/1992 | Richardson | 252/518 |
| 5,236,737 | 8/1993 | Linton | 427/252 |
| 5,364,566 | 11/1994 | Jacobson | 252/521 |
| 5,472,640 | 12/1995 | Brückner et al. | 252/518 |

FOREIGN PATENT DOCUMENTS

| | | |
|---|---|---|
| 139557 | 5/1985 | European Pat. Off. . |
| 0373575 | 12/1989 | European Pat. Off. . |
| 56-140028 | 11/1981 | Japan . |
| 59-86637 | 5/1984 | Japan . |
| 60-253112 | 12/1985 | Japan . |
| 61-264345 | 4/1986 | Japan . |
| 62-18564 | 1/1987 | Japan . |
| 62-216105 | 9/1987 | Japan . |
| 63-20342 | 1/1988 | Japan . |
| 63-34180 | 2/1988 | Japan . |
| 63-200158 | 8/1988 | Japan . |
| 63-215745 | 9/1988 | Japan . |

OTHER PUBLICATIONS

"Journal of Materials Science", 21 (1986), pp. 2731–2734 (No Month Available).

*Primary Examiner*—Paul Lieberman
*Assistant Examiner*—M. Kopec

[57] ABSTRACT

An electroconductive composition comprising a two-dimensional network of antimony-containing tin oxide crystallites in association with amorphous silica, the composition according to one aspect of the invention comprising a powder of submicron to tens of micron size particles capable of forming a conductive network within a carrier matrix, such as a thin film matrix, and a process for preparing the composition.

19 Claims, 3 Drawing Sheets

.1μ

.1μ

ELECTROCONDUCTIVE COMPOSITION AND PROCESS OF PREPARATION

BACKGROUND OF THE INVENTION

The present invention relates to an improved electroconductive composition which comprises antimony-containing tin oxide in which the tin oxide is predominately crystalline and the composition exists in a unique association with silica or a silica-containing material, e.g., a silicate. More particularly, the present invention relates to an improved electroconductive powder composition comprising tens of microns to sub-micron size particles having a thin surface layer of amorphous silica or silica-containing material, said material having a thin surface coating layer which comprises a network of antimony-containing tin oxide crystallites and to a process for preparing the composition.

U.S. Pat. Nos. 4,373,013 and 4,452,830 describe the preparation of an electroconductive powder having a structure comprising titanium oxide particles as nuclei with a coating of antimony-containing tin oxide on the surface of the titanium oxide particles. The powder is prepared by mixing an aqueous dispersion of titanium oxide particles with a solution containing a hydrolyzable tin salt and a hydrolyzable antimony salt. The titanium oxide particles become coated with antimony-containing tin oxide and can then be recovered by filtration.

"Journal of Materials Science", 21 (1986), pp. 2731–2734, describes the preparation of antimony-doped $SnO_2$ films by thermal decomposition of tin 2-ethylhexanoate on glass substrates. Reagent grade tin 2-ethylhexanoate and antimony tributoxide were used as the source of tin and antimony, respectively, and application of the film onto the substrate was accomplished by dipping the substrate into an alcoholic solution containing the organometallic compounds and then drying the applied solution. The substrate used was soda-lime glass which was previously coated with about a 30 nm layer of $TiO_2$, $SiO_2$ or $SnO_2$ (with 8 wt % Sb) by thermal decomposition of organometallic compounds. The resistivity of the resulting film in which the substrate had a precoating of $SiO_2$ was one-thirtieth of the resistivity of the antimony-doped tin oxide film on the uncoated glass substrate. For the range of films prepared, however, electrical properties were noted as being more or less poor compared with films obtained by other methods, such as, spraying or chemical vapor deposition.

Japanese Patent No. SHO 63[1988] 20342 describes a method of manufacturing fine electroconductive mica particles by coating them with a tin oxide/antimony oxide mixture. This coating is accomplished by treating the mica with tin tetrachloride, antimony trichloride, and a hydroxyl-containing, low-molecular-weight fatty acid.

Compositions which are capable of imparting electrocondutive properties to thin films, such as, in polymer films, magnetic recording tapes, work surfaces and in paints, are not always economically attractive or reliable for a given application. Electroconductive compositions, e.g., powders, which are currently available for use as conductive pigments in paint, for example, suffer a variety of deficiencies. Carbon black may be used to impart conductivity, but this can limit the color of the paint to black, dark gray and closely related shades. Titanium dioxide powders, coated with antimony-doped tin oxide by methods of the prior art, normally require high pigment/binder ratios, e.g., 200/100, in order to achieve minimum acceptable surface conductivity. Such a high pigment loading is expensive and can limit the color range and transparency of the resulting paint to very light shades and pastels. A simple powder of antimony-doped tin oxide may be used, but cost and color limitations can be unfavorable.

Mica powders can be made conductive by coating the particles directly with antimony-doped tin oxide, but the preparation of such powders can be expensive and difficult because of the poor affinity of tin and antimony intermediates for the surface of the mica. Organic complexing agents and/or organic solvents are typically used to facilitate the reaction of tin and antimony intermediates with the mica surface. Even with these additives, a significant portion of the tin and antimony remain in solution or as free particles. This reduces the effective conductivity of the powder and increases the coat, since a significant amount of the tin and antimony values are lost when the coated particles are recovered from the reaction medium. In addition, the tin and antimony values remaining in solution must be removed before the waste solution which remains is discharged. Finally, the antimony-doped tin oxide layer has been found to bond poorly to the mica and may delaminate during subsequent processing, such as during milling or during incorporation into a polymer vehicle, e.g., a paint formulation or polyester film.

SUMMARY OF THE INVENTION

The present invention is an electroconductive composition which comprises a two-dimensional network of crystallites of antimony-containing tin oxide which exists in a unique association with amorphous silica or a silica-containing material. The antimony-containing tin oxide forms a two-dimensional network of densely packed crystallites on the surface of the silica or silica-containing material. The silica or silica-containing material is a substrate, and the network comprises a generally uniform layer of crystallites in which the crystallites form an electrically conducting pathway to adjacent crystallites. The layer of tin oxide crystallites is typically about 5 to 20 nm in thickness but covers the surface of a particle with major dimensions that are typically ten to ten thousand times as large as the thickness of the tin oxide layer. The crystallites are, thus, part of a continuous conducting layer in two dimensions.

The silica substrate can be practically any shape. In the form of flakes or hollow shells, satisfactory results may be achieved when the two-dimensional network is formed on only one side of the silica substrate. In general, however, best results are obtained when practically all of the exposed surface of the silica substrate is coated with the crystallite layer.

According to one aspect of the invention, the composition is a powder comprising shaped particles of amorphous silica which are coated with a two-dimensional network of antimony-containing tin oxide [$SnO_2$(Sb)] crystallites. The finished particles, typically, are tens of microns to sub-micron in size, and they, in turn, are capable of forming an electroconductive network within the matrix of a thin film, such as within a paint film. The shaped particles of amorphous silica may be in the form of needles, platelets, spheres, dendritic structures or irregular particles. These provide an extended surface for the deposition of the antimony-containing tin oxide.

In a preferred embodiment, the amorphous silica powder comprises thin shells or platelets less than about 20 nm in thickness. The powder, when dispersed in a vehicle, is generally transparent, and its presence as a component of pigment in paint has little impact on color and related properties.

In another embodiment of the invention, the composition is a powder comprising shaped particles, each of which has a structure comprising an inert core material having a surface coating layer of amorphous silica, which, in turn, is coated with a two-dimensional network of antimony-containing tin oxide crystallites. These powders are particularly useful for incorporation into plastics and elastomers where the shear stresses involved in molding useful articles might degrade otherwise conductive powders which comprise hollow shells or thin flakes.

The present invention also includes a process for preparing the electroconductive composition which comprises:

(a) providing a substrate of amorphous hydroxylated silica or active silica-containing material, (b) applying a coating layer to the substrate surface consisting essentially of hydrous oxides of antimony and tin, and (c) calcining the coated substrate at a temperature in the range of 400° to 900° C. in an oxygen-containing atmosphere.

The coating layer of hydrous oxides of antimony and tin is applied to the hydroxylated substrate surface by adding aqueous solutions of hydrolyzable Sn and Sb salts to a slurry containing the silica at a pH in the range of about 1.5 to about 3.5, preferably at a pH of 2.0. Calcining the coated silica substrate perfects the crystalline phase of the $SnO_2$(Sb) coating layer which imparts the desired electroconductive properties to the individual particles of the composition.

According to one aspect of the process, the substrate of amorphous hydroxylated silica or active silica-containing material is prepared by coating a finely divided solid core material with active silica and then removing the core material without unduly disturbing the silica coating. The substrate thus produced comprises hollow silica particles which are substantially translucent and which have the general shape of the core material. It will be appreciated that the silica coating should be sufficiently thin, for this purpose, so as not to reflect light. This will normally mean a thickness of lens than about 250 nm. For most applications, thicknesses in the range of about 5 to 20 nm are preferred.

Active silica is conveniently prepared by gradually neutralizing an aqueous solution of sodium silicate or potassium silicate with a mineral acid, such as, for example, sulfuric acid or hydrochloric acid.

Active silica-containing materials may conveniently be applied as coatings for a selected core material by including other components along with the active silica in the reacting solution. For example, by adding sodium borate along with the sodium or potassium silicate, a silica-boria coating may be obtained. Such coatings are effective as a substrate in practicing this invention so long as the surface of the coating contains hydroxylated silica functionalities. If the other component or components present in the silica-containing substrate inhibit the retention of hydroxyl groups on the substrate surface, then the subsequent $SnO_2$(Sb) coating may not adhere completely and may, thus, be less effective.

According to another aspect of the invention, the core material may remain encapsulated within the amorphous silica coating so long as its presence does not adversely affect the proposed end-use of the finished composition and so long as it remains stable during subsequent processing.

In a preferred embodiment, the core is a mica platelet with a thickness of less than 250 nm. Platelets of this type are nearly transparent when dispersed in a suitable vehicle, yet they provide conductivity at low loadings in the vehicle. Muscovite is a preferred form of mica for use in the invention.

In yet another aspect of the process, the coating layer of hydrous oxides of antimony and tin is applied to the hydroxylated silica substrate surface in the presence of a grain refiner, or a mixture of grain refiners, selected from soluble compounds of alkali metals, alkaline earth metals, transition metals, and rare earth elements. Alkaline earth chlorides and zinc chloride are preferred. In this regard, the present invention includes electroconductive powders which are prepared by applying, i.e., depositing, a coating layer of hydrous oxides of antimony and tin to the surface of a substrate other than amorphous hydroxylated silica where the deposition is accomplished in the presence of from about 500 parts per million up to about 3 molar of a grain refiner as defined above. The finished composition can contain up to about 10% by weight of the grain refiner, although a concentration of from 110 ppm to 1% to weight is preferred.

The composition of this invention in a preferred embodiment comprises a powder which is particularly useful as a pigment in paint formulations for automotive paint systems. The finished powder of this invention comprises particles capable of forming a generally transparent conductive network within the paint film at a pigment/binder loading ratio as low as 15/100 or even lower, such that the transfer efficiency can be improved when a subsequent coat, e.g., the top coat, is applied electrostatically. According to one aspect of the invention, the particles are shaped and preferably needle-like which results in a generally low pigment volume concentration within the paint vehicle.

DETAILED DESCRIPTION OF THE INVENTION

Figure 1:
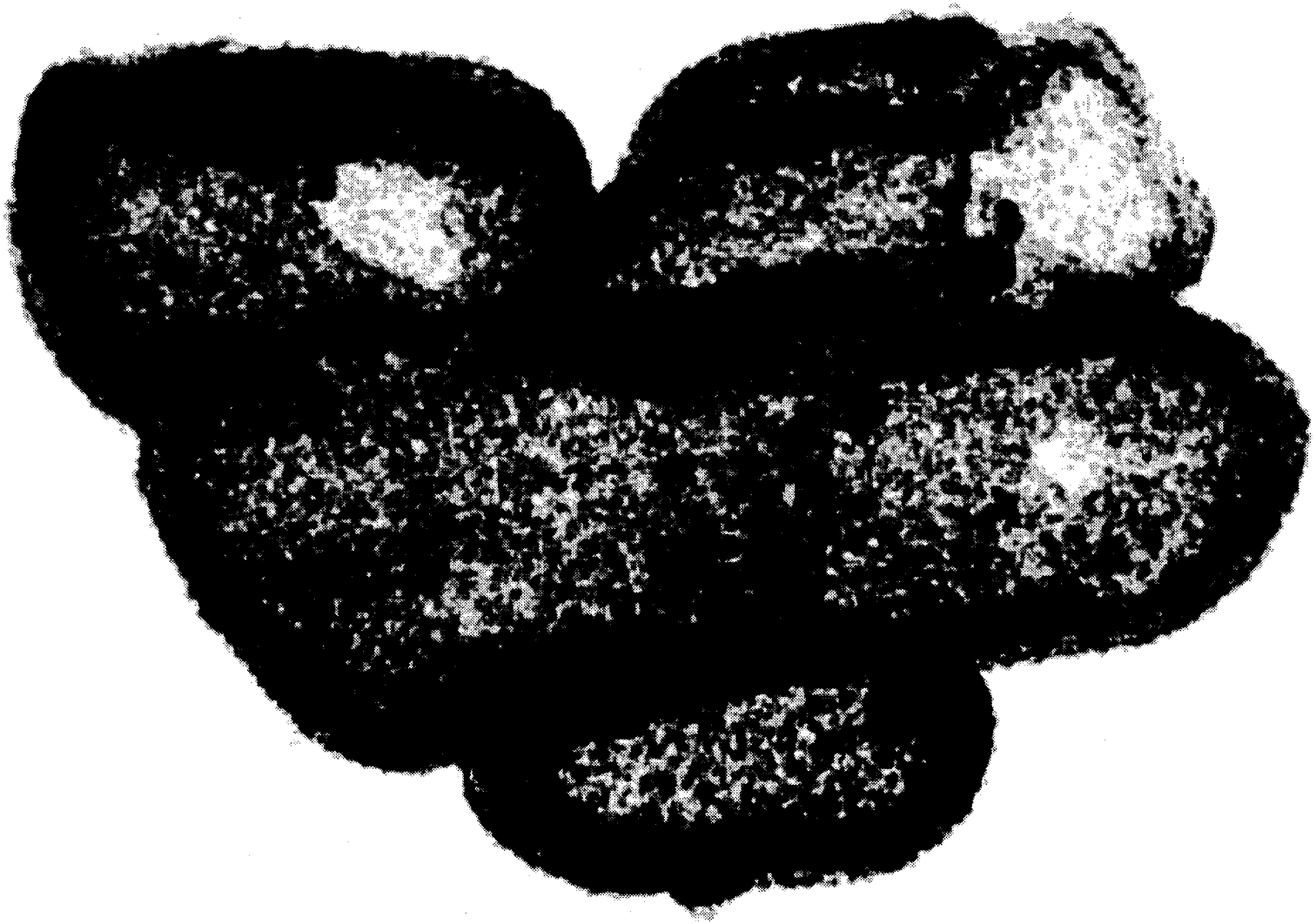
FIG. 1 is an electron micrograph which shows a group of electroconductive particles, in the form of shells, which have been prepared according to the process of the invention.

The present invention is a composition which comprises a two-dimensional network of antimony-containing tin oxide crystallites which exist in a unique association with amorphous silica or with a silica-containing material. The composition, when in the form of particles, is uniquely capable of forming an interconnecting conductive network when incorporated as a component within a carrier matrix or a solution which is applied and dried on a surface as a thin film. The carrier matrix may take any of a variety of forms, including paint film, fiber, or other shaped article. The particles represent an association of the two-dimensional network of antimony-containing tin oxide crystallites with amorphous silica or a silicon-containing material which is accomplished by the process of this invention and comprises the steps of:

(a) providing a substrate of amorphous hydroxylated silica or active silica-containing material, (b) applying an outer conductive coating layer to the substrate surface consisting essentially of hydrous oxide of antimony and tin, and (c) calcining the coated substrate at a temperature in the range of 400° to 900° C. in an oxygen-containing atmosphere.

The term "silica-containing material" as used herein means a material, i.e., a composition, such as a metal silicate, amorphous silica-containing materials, or, in general, a material having an extensive covalent network involving $SiO_4$ tetrahedra. Such compositions offer the potential for surface hydroxyl formation, a feature believed to be important in the chemical interaction between the silica-containing solid and the aqueous solution of tin and antimony salts in forming the compositions of this invention.

The term "active silica-containing material" as used herein means a silica-containing composition that has been activated by the creation of surface hydroxyl groups. This is most conveniently achieved by direct precipitation, from aqueous solution, of amorphous silica, alkaline earth silicates, or transition metal silicates such as zinc silicate onto the surface of the core particles. Active borosilicate compositions may also be prepared in this manner. In general, silicate surfaces which have been dried or heated extensively will no longer contain effective concentrations of surface hydroxyl groups and will be inactive. Such surfaces may, however, be reactivated by extended treatment with reactive aqueous solutions, such as hot caustic. Mica surfaces may, for example, be activated in this manner, but this type of activated surface typically is not as reactive with tin/antimony intermediates as is a freshly precipitated active silica coating. In general, active silica-containing material which is prepared by direct precipitation from aqueous solution is preferred.

Generally speaking, maximum utility for the composition of this invention is realized when the substrate comprises a powder, i.e., finely divided particles which are tens of microns to sub-micron in size. The powder particles are composed of amorphous silica or a silica-containing material, or they are composed of an inert core material having an amorphous silica coating or a coating of a silica-containing material.

According to one aspect of the invention, the powder particles are shaped particles which are somewhat elongated rather than spherical or equiaxial and have an aspect ratio of from at least about 2.0 up to about 50. An important criterion for the silica, or silica-containing, particles is that, as a finished dry powder, they are capable of forming an interconnecting electroconductive network within a thin film, such as a paint film, or when used as a filler in a bulk polymeric material.

Particle shapes which are capable of forming such an effective interconnecting network and which are contemplated for use in this invention are selected from rods, whiskers, platelets, fibers, needles, shells and shell parts, and the like. Particles of this invention which are equiaxial in shape may also be used, and they may even be preferred in applications where very high electrical conductivity is needed and higher pigment/binder ratios can be tolerated.

In one aspect of the invention, the powder particles have the shape of platelets. This shape facilitates the particles forming an interconnecting electroconductive network within a thin film. In a preferred embodiment of the invention, the particles are platelets of mica, with a thickness of less than 250 nm. These particles, when dispersed in selected binders, are practically transparent, yet they provide electrical conductivity at relatively low powder loadings.

Polymeric materials may be conveniently rendered conductive by filling the polymer composition with a powder of equiaxial, i.e., generally spherical, particles of this invention. It will be appreciated that the preferred particle shape for any specific application will depend on many factors. While acicular particles are generally preferred for use in paint films, and equiaxial shaped particles are generally preferred for use in filled plastics, other factors may lead to a different preference in a specific application.

In a preferred embodiment of this invention the substrate of amorphous silica is a hollow shell which is prepared by coating a finely divided core material with active silica and then removing the core material which leaves behind a silica shell as the substrate for receiving the antimony-containing tin oxide surface coating layer. A primary function of the core material is merely to provide a shaped particle on which the amorphous silica substrate can be deposited. The core material must, of course, largely maintain its physical stability during the silica coating process.

Formation of the silica substrate can be accomplished by first suspending the core material in water and then adding active silica while maintaining the pH of the suspension at a value in the range of 8 to 11. This procedure is described in greater detail in U.S. Pat. No. 2,885,366 (Iler), the teachings of which are incorporated herein by reference. In general, active silica is very low molecular weight silica, such as silicic acid or polysilicic acid or metal silicates, which may be added as such to the suspension, or formed in situ as by the reaction of an acid with a silicate.

Suitable core materials are carbonates such as, for example, $BaCO_3$ and $CaCO_3$. Other materials may also be used provided that they will readily accept an adherent skin of amorphous hydroxylated silica, they have low solubility at the coating conditions, they can be easily removed from the silica shell by a variety of techniques including extraction, reaction and oxidation, and/or their chemical composition will not interfere with application of the tin oxide coating layer The use of $BaCO_3$, $CaCO_3$ and $SrCO_3$ as the core material is particularly advantageous because each can provide an in situ source of grain refiner, the importance of which is discussed in more detail hereinafter.

In another aspect of the invention, the core material remains encapsulated within the shell of amorphous silica or silica-containing material, i.e., it is not removed. Examples of suitable core materials for this embodiment include $TiO_2$, mica, Kaolin, talc, and $BaSO_4$. In either case, the silica coating is coherent and is bound upon the core material forming a coating layer which is substantially uniform in thickness from about 5 to 20 nm. In applications where transparency is a desirable feature of the polymer matrix or where flexibility in coloring the polymer matrix is important, then the core material for the electroconductive powder should have an index of refraction no higher than that of mica.

In practice, an aqueous suspension, i.e., dispersion, of the desired core material is prepared, and the dispersion is brought to a pH of 10 by adding an appropriate amount of an alkali, such as NaOH, KOH, or $NH_4OH$. The particles comprising the core material should generally have a specific surface area (BET method $N_2$ adsorption) in the range of 0.1 to 50 $m^2/g$, but for best results a specific surface area of 2 to 8 $m^2/g$ is preferred. In general, the preferred surface area will be in the lower part of the above range for high density materials and in the higher part of the above range for low density materials.

The concentration of the core material in the dispersion is not especially critical. It can range from 100 to 400 g/liter, but for best results the dispersion should be uniform. Having prepared a dispersion of the core material, a soluble silicate, such as sodium silicate or potassium silicate, is added to facilitate the formation of the silica coating. A convenient form of sodium silicate is a clear aqueous solution with a $SiO_2/Na_2O$ molar ratio of 3.25/1 which has been filtered to remove all insoluble residue. A range of 2 to 50% by weight of silica based on the amount of core material in the dispersion can be added, but 6 to 25% by weight of silica is preferred. To promote the reaction rate, the dispersion, i.e., slurry, is heated to a temperature in the range of about 60° to 100° C.

The alkali component of the sodium silicate or potassium silicate is next neutralized by adding a dilute acid slowly to the slurry over a predetermined period of time which is dictated by the amount of silica present so as to avoid the formation of "free" silica, i.e., silica particles which are not attached to the core material. Mineral acids selected from $H_2SO_4$, HCl, $HNO_3$ and the like are suitable for the neutralization. Acidic metal salts, such as calcium chloride, may also be used. In this procedure, some calcium becomes incorporated into the silica coating and later becomes available as a grain refiner in the tin oxide coating step. The larger the amount of silica present, the longer will be the time required for neutralization; however, a silica deposition rate of 3% of the weight of the base powder per hour is normally satisfactory to insure formation of the silica coating layer. The important consideration is to keep the addition rate slow enough to avoid precipitating free silica. The slurry is then held at temperature for at least one-half hour after neutralization to ensure a complete reaction of the hydroxylated silica coating layer. The silica coated particles can then be isolated, washed, and dried prior to beginning the next step of the process, or they can be retained as a slurry, and the process continued.

Alternatively, the amorphous hydroxylated silica may be prepared by simultaneously adding the alkali silicate solution and the acid solution to a heel, i.e., a quantity already present in the reactor, of alkaline water containing the powder to be coated. With this technique, the pH can be kept constant throughout most of the reaction. Under certain circumstances, this can facilitate the uniform coating of the silica onto the substrate.

Hydroxylated silica is silica which has hydroxyl groups on the surface. This may be obtained by precipitating the silica from aqueous solution under alkaline conditions. Preferred amorphous hydroxylated silicas are obtained by carrying out the precipitation slowly (over 1–3 hours) and at elevated temperatures, such as around 90° C. Under these processing conditions, the silica is coherent, i.e., the silica adheres to the substrate and takes the general shape of the substrate particle. Typically, particles coated with a coherent silica coating will have a surface area, by nitrogen adsorption, which is approximately the same as, or slightly lower than, the area of the uncoated powder. Particles with a non-coherent, e.g., porous, silica coating will have such higher surface areas, as much as 10 to 100 times higher. While coherent coatings are preferred in practicing the invention, a moderate degree of porosity in the coating is not particularly harmful. In particular, when hollow shells are desired, a small amount of porosity is beneficial in facilitating the extraction of the core material.

As noted above, the formation of the amorphous hydroxylated silica is preferably carried out at a temperature of 60° to 90° C. to facilitate densification of the silica. However, lower temperatures in the range of 45° to 75° C. can be used if a densification aid, such as, for example, $B_2O_3$, is present in the reaction mixture.

When the process is continued from previously dried silica coated particles, they are first re-dispersed in water, and the resulting slurry is heated to a temperature in the range of about 40° to 100° C. Next, the core material may be dissolved and extracted by treating, for example, with an acid. This may be accomplished by heating an aqueous slurry of the silica coated particles to 40° to 100° C., adding hydrochloric acid while stirring until the pH reaches a value in the range or 1.5 to 3.5, but preferably the pH should be 2.0 for best results. The core material dissolves, leaving hollow shaped particles of amorphous silica which are the substrates onto which the antimony-doped tin oxide coating is applied.

The core material can be extracted by other means, such as, for example, by oxidation during calcining where the core material is a graphite powder. Other core materials contemplated for use according to this invention includes finely divided metal powders, such as aluminum and copper, and metal oxides such as iron oxide.

Where $BaCO_3$ is the core material, an appropriate solvent is HCl, which dissolves the $BaCO_3$ liberating $CO_2$ and $Ba^{++}$ ions in solution. The choice of solvent is critical to the extent that a solvent which will react with the core material to form an insoluble reaction product should not be used.

As previously mentioned, according to one aspect of the invention, the core material may remain encapsulated throughout final processing. The presence or absence of a core material in practicing the invention may enhance certain optical or other properties and is for the convenience of the operator. In a preferred embodiment of this invention, the use of a removable core material, especially $BaCO_3$ or $CaCO_3$, facilitates the formation of a shaped amorphous silica substrate. Alternatively, any convenient source of amorphous hydroxylated silica or hydroxylated silica-containing material, preferably hydroxylated silica, can be used as a substrate in practicing this invention.

The outer conductive coating layer can be applied to the amorphous hydroxylated silica substrate by preparing separate aqueous solutions of hydrolyzable tin and antimony salts and adding them simultaneously to the substrate slurry along with an appropriate amount of a strong base to maintain the pH of the slurry in the desired range. While it is generally preferred to add the tin and antimony solutions simultaneously, and indeed they may conveniently be first mixed together and then added as one solution, it is also possible to add the solutions sequentially. Solvents for preparing the individual tin and antimony salt solutions can be any solvent which dissolves the salt without adverse reaction. However, water or acidic aqueous solutions are preferred solvents. The tin salt solution may conveniently be prepared by dissolving $SnCl_4.5H_2O$ in water. The antimony salt solution may conveniently be prepared by dissolving $SbCl_3$ in a nominal 37% aqueous solution of HCl. Sn and Sb chlorides are the preferred salts, but other salts, such as, for example, sulfates, nitrates, oxalates, and acetates can be used. In general, tetravalent tin salts and trivalent antimony salts are preferred as starting materials. Although the concentration of the salts in solution is not critical, it is preferred that the concentrations are kept within the practical ranges of 50 to 500 g of tin oxide/liter and 0.5 to 250 g Sb/liter to facilitate uniform coating while avoiding unnecessary dilution. According to one aspect of the invention, the individual Sn and Sb solutions can be combined into a single solution which is then added to the slurry slowly over a predetermined period of time based on the percent $SnO_2$/(Sb) being added. Typically, a rate of 25% of the total $SnO_2$ and Sb can be added per hour. Rapid addition of the $SnO_2$(Sb) solution will result in nonuniform coating of the $SnO_2$(Sb) onto the silica substrate while very slow addition of the $SnO_2$(Sb)

solution will unnecessarily prolong the operation. The temperature of the slurry during deposition of the antimony-doped tin oxide coating layer is maintained in the range of 25° to 100° C. under continuous agitation.

In a preferred embodiment, and a critical feature of the invention, simultaneously with the addition of the salts to the slurry, the pH of the system is kept constant at a value of from 1.5 to 3.5, and most preferably at 2.0, by adding alkali, e.g., NaOH, KOH, or the like during the addition. In this pH range the active, or hydroxylated, silica surface of the substrate becomes very receptive to an association with, i.e., the deposition of, hydrous oxides of tin and antimony. Brief excursions of pH of levels above or below the 1.5 to 3.5 range are generally not harmful, but extensive processing substantially outside this range will degrade the continuity of the two-dimensional network of antimony-doped tin oxide crystallites and, thus, will adversely affect the conductive properties of the resulting powder. The tin and antimony salts hydrolyze and deposit on the surface of the silica and form a generally uniform layer typically having a thickness in the range of about 5 to 20 nm, and more typically a thickness of about 10 nm. After calcination, the $SnO_2$(Sb) crystals are typically about 10 nm in diameter, but individual crystals may be as large as 20 nm in diameter or larger. It will be appreciated that some crystallites may be significantly larger than 20 nm, ranging up to 50 or 60 nm. The limited quantity of these larger crystallites does not affect the overall translucency of the powder. It has been observed that as the quantity of antimony-containing tin oxide in the outer coating layer increases, the resistivity of the finished dry powder will decrease, i.e., the conductivity will increase. Generally, the antimony content of the tin oxide layer can range from 1 to 30% by weight, but best results are achieved when the antimony content is about 10% by weight.

The coated particles obtained in this manner are then isolated by any convenient solid-liquid separation procedure, such as, for example, by filtration, and then washed free of salts with water and dried. Drying can be conveniently accomplished at a temperature of up to about 120° C.; however, drying is optional if the particles are to be calcined immediately following isolation and washing.

The isolated particles are next calcined in an oxygen-containing atmosphere at a temperature in the range of from 400° to 900° C., preferably 600° to 750° C., for a period of time sufficient to develop the crystallinity of the tin oxide phase and establish the conductivity. The time required will depend on the temperature and on the geometry of the furnace and on processing conditions. In a small batch furnace, for example, the time required for calcination is typically from 1 to 2 hours. Calcination is critical to the process of the invention because it serves to perfect the crystal phase of the antimony-containing tin oxide outer coating layer which, in turn, imparts the electroconductive properties to the particles.

In yet another aspect of the invention, the conductive properties of the composition can be enhanced by accomplishing the deposition of the antimony-containing tin oxide outer coating layer in the presence of a grain refiner, or a mixture of grain refiners, selected from alkali metals, alkaline earth metals, transition metals and rare earth elements which enhance the uniformity of $SnO_2$ deposition on the $SiO_2$ surface and minimize grain growth during subsequent calcination. The exact function of the grain refiners is not entirely understood, but concentrations of as little as 500 parts per million or up to about 3 molar or higher of a grain refiner, or mixture of grain refiners, in the slurry during the deposition of the tin oxide conducting phase results, after calcination, in improved electroconductive properties of the composition. Preferred grain refiners are soluble salts of Ba, Ca, Mg, and Sr, although soluble salts of alkali metals, rare earth metals, other alkaline earth metals and certain transition metals, such as Fe and Zn, are expected to produce satisfactory results.

When the coating layer of hydrous antimony and tin oxides is to be applied according to the process of the invention in the presence of a grain refiner as defined above, it has been found that substrates other than amorphous hydroxylated silica, such as substrate selected from $BaSO_4$, $SrSO_4$, $CaSO_4$, graphite, carbon, and $TiO_2$, can be used which yield powders having unexpected electroconductive properties. Preferred grain refiners for such substrates are selected from $Ca^{++}$, $Ba^{++}$, and $Sr^{++}$. Such non-silica substrates are generally powders which have a low solubility under the reaction conditions used to apply the coating of hydrous antimony and tin oxides. Suitable substrates are also inert and generally unreactive with the antimony and tin oxides during calcination. Electroconductive powders based on a non-silica substrate will generally contain from about 100 parts per million, or more, of the grain refiner, or mixture of grain refiners.

The electroconductive powders of this invention are characterized by a high surface area, as determined by nitrogen adsorption, relative to the surface area that would be expected for the average particle size as observed by electron microscopy. As previously noted, the electroconductive powder of this invention is typically submicron to tens of microns in particle size. As observed under an electron microscope, the silica surface is seen to be densely populated with fine crystallites of antimony-doped tin oxide, each crystallite typically in the range of 5 to 20 nm. This crystallite size range is confirmed by X-ray diffraction line broadening. The high surface area results from the population of fine crystallites. The actual surface area, as measured by nitrogen adsorption, is typically in the range of 30 to 60 $m^2/g$.

Figure 2:
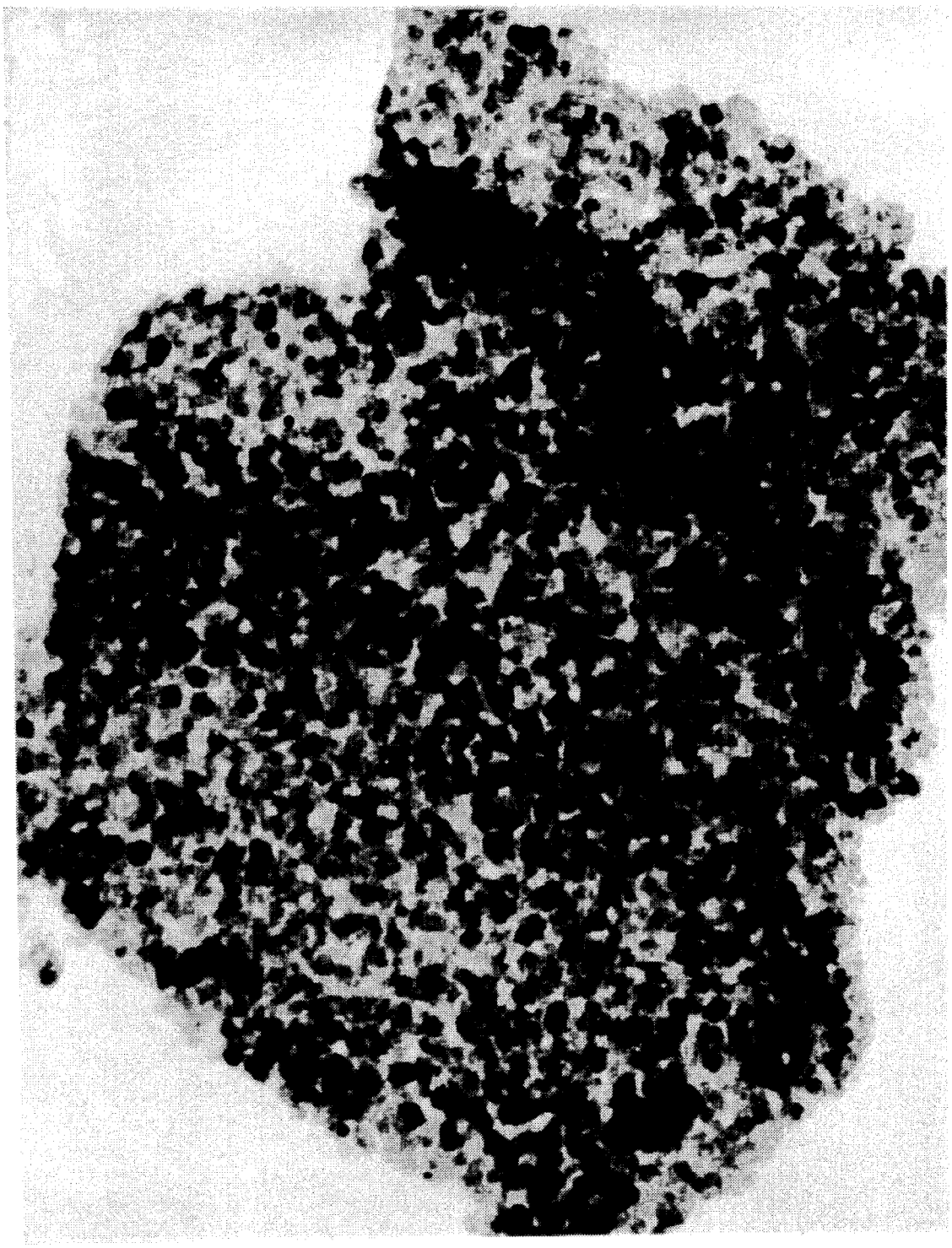
FIG. 2 is an electron micrograph, at higher magnification, of a fragment of a shell which is coated with a conducting layer of antimony-containing tin oxide crystallites according to the invention.

Referring now to the Figures, FIG. 1 is an electron micrograph which shows a group of electroconductive particles, in the form of shells, which have been prepared according to the invention. Three lighter areas can be seen which are believed to be holes in the shells which were formed as the core material was being removed during processing. The surfaces of the shells, seen in a somewhat cross-sectional view, are uniformly coated with a two-dimensional network of antimony-doped tin oxide crystallites. FIG. 2 is an electron micrograph, at higher magnification, of a fragment of a shell which has been prepared according to the invention. The two-dimensional network of antimony-doped tin oxide crystallites can be seen in this view. Some of the crystallites appear very dark, while others appear as various lighter shades of grey to near-white. This variation is due to the random orientation of the crystallites on the silica surface and does not indicate a variation in composition.

FIGS. 1 and 2 show closely packed antimony-doped tin oxide crystallites on the surface of the amorphous silica with the result that the interstices, i.e., pores, between the crystallites are very small. Thus, electrical resistance between crystallites, and between individual coated particles which are in contact, is minimized. The equivalent pore diameter, as measured by nitrogen adsorption/desorption is below 20 nm, and preferably below 10 nm.

The electroconductive powders of this invention are further characterized by a low isoelectric point, e.g., in the range of from 1.0 to 4.0, typically 1.5 to 3.0. By contrast, antimony-doped tin oxide powders, prepared in the absence of silica, will have an isoelectric point substantially below 1.0, and typically below 0.5. The silica itself has an isoelectric point of from 2 to 3.

Electroconductive powder samples which were prepared according to this invention were evaluated by comparing dry powder resistances. A relative comparison of dry powder samples is made possible so long as the particles size and shape do not vary substantially among the samples. Generally, the lower the relative resistance in dry powder evaluation, the lower the resistivity in an end-use system, although many other factors, such as, for example, the ability to form an interconnecting network in the end-use carrier matrix or vehicle system, may also affect end-use conductance.

In an end-use paint primer system, the electroconductive powder of this invention can be evaluated by measuring the surface conductivity of the dry paint film in which the powder has been incorporated as a component of the paint pigment. A simple meter has been developed by the Ransburg Corporation to measure the surface conductivity of paint films. This meter, which is known as the Ransburg Sprayability Meter, is calibrated in Ransburg Units (RU's) from a value of 65 to a value of 165. Any paint film which demonstrates a surface conductivity of more than 120 RU's is considered to have satisfactory surface conductivity.

Figure 3:
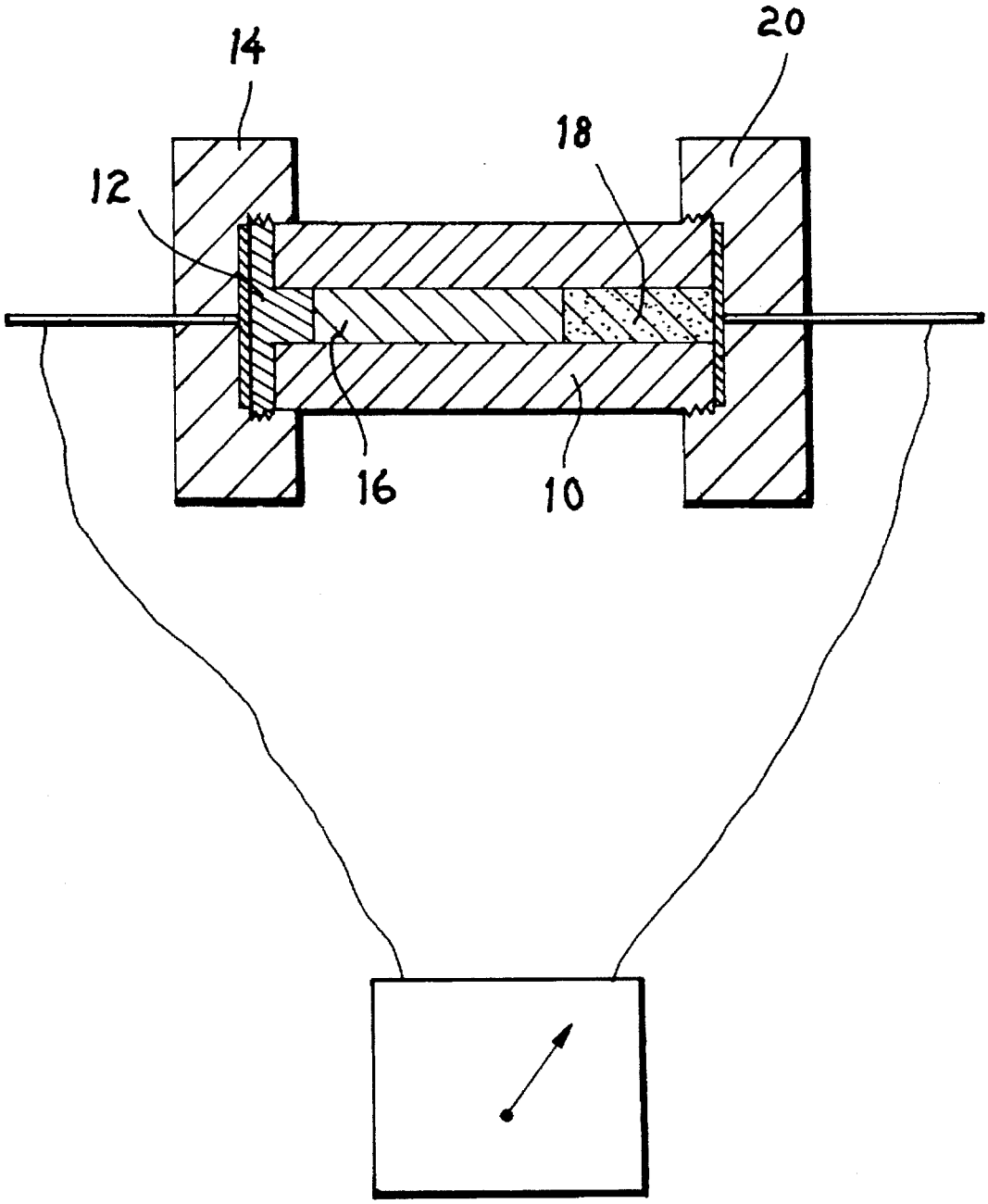
FIG. 3 is a sectional view of a device used to measure dry powder resistivities of individual samples of compositions which were prepared as dry powders according to the invention.

The dry powder technique which was used for early evaluations of the conductive powder of this invention utilizes a device as shown in partial section in FIG. 3. The device comprises a hollow cylinder 10 of a non-conducting material, such as plastic, having a copper piston 12 located at one end and held in place by an end cap 14. A copper rod 16 of a predetermined length shorter than the cylinder is placed inside the cylinder in contact with the piston as shown, and a powder sample to be measured 18 is placed in the hollow portion of the cylinder which remains. A second end-cap 20 is placed over the end of the cylinder which contains the powder sample, and copper leads are attached to the ends of the cylinder for connection to an ohm meter. In practice, the copper piston drives the copper rod to compress the individual powder samples to a given compaction, and resistivity is measured by the ohm meter for each sample. In the examples described below, the relative resistances were measured by filling the cylindrical cavity (0.64 cm in diameter by 1.72 cm long) with powder, and tightening the end-caps manually to compress the powder.

The electroconductive composition of this invention and its method of preparation are illustrated in more detail in the following examples. For convenience, the examples are summarized in Table 1.

TABLE 1

| Example No. | Silicate Source | Core Material | Acid Source: Silica Deposition | Acid Source: Core Leaching | Intermediate Isolation |
|---|---|---|---|---|---|
| 1 | $Na_2SiO_3$ | $BaCO_3$ | $H_2SO_4$ | HCl | Filter |
| 2 | $K_2SiO_3$ | $CaCO_3$ | HCl | HCl | Filter |
| 3 | $K_2SiO_3$ | $CaCO_3$ | HCl | HCl | Decant |
| 4 | $Na_2SiO_3$ | $BaCO_3$ | HCl | HCl | Decant |
| 5 | $K_2SiO_3$ | $BaCO_3$ | HCl | HCl | Filter |
| 6 | $Na_2SiO_3$ | $TiO_2$ (w & w/o $CaCO_3$) | $H_2SO_4$ | None | Filter |
| 7 | $Na_2SiO_3$ | $BaSO_4$ | $H_2SO_4$ | None | Filter |
| 8 | $K_2SiO_3$ | Ppt $SiO_2$ | HCl | None | None |
| 9 | $K_2SiO_3$ | Ppt $SiO_2$ | HCl | None | None |
| 10 | $K_2SiO_3$ w $B_2O_3$ | $BaCO_3$ | HCl | HCl | Filter |
| 11 | None | $BaSO_4$ | None | None | None |
| 12 | $K_2SiO_3$ | Mica | HCl | None | None |
| 13 | $K_2SiO_3$ | Kaolinite | HCl | None | None |

EXAMPLE 1

(A) In an 18-liter, agitated polyethylene beaker, 3 liters of water were brought to a pH of 10.0 with sodium hydroxide. A stock solution of sodium silicate was prepared and filtered to remove insoluble material. The stock solution has a $SiO_2/Na_2O$ molar ratio of 3.25/1, and contained 398 g of $SiO_2$ per liter of solution. 65 ml of this solution were added to the 18-liter beaker. Thereafter, 1350 g of $BaCO_3$, which had been predispersed in one liter of water, was added to form a slurry. The slurry was heated to 90° C. in one-half hour by the introduction of steam, after which the pH was 9.7. Next, a sodium silicate solution and a sulfuric acid solution were simultaneously added over a period of 3 hours, while stirring the slurry vigorously and while maintaining the pH at 9.0. The sodium silicate solution was prepared by diluting 342 ml of the above sodium silicate stock solution to 600 ml with water. The sulfuric acid solution was prepared by diluting 69 g of 96% $H_2SO_4$ to 600 ml with water. All of the sodium silicate solution was added to the slurry. Sufficient sulfuric acid was added to maintain the pH at 9.0. After the simultaneous addition was complete, the slurry was then digested at 90° C. for one-half hour, and the resulting silica-coated $BaCO_3$ particles were isolated by filtration, washed with water to remove soluble salts, and dried overnight at a temperature of 120° C. 1485 g of dry powder were recovered.

(B) In a 3-liter, agitated glass flask, 250 g of the powder prepared in (A) above were dispersed in 1 liter of water, and the resulting slurry was heated to a temperature of 90° C. 164 ml of nominal 37% HCl was then added slowly to the slurry which lowered the pH to a value of 2.0 and dissolved the $BaCO_3$ material. Next, a $SnCl_4/SbCl_3/HCl$ stock solution was prepared by dissolving $SnCl_4.5H_2O$ in water and dissolving $SnCl_3$ in nominal 37% HCl. These were combined in a ratio to give the equivalent of 10 parts of $SnO_2$ to 1 part of Sb, and diluted with water to yield a solution containing the equivalent of 0.215 g $SnO_2$/ml and 0.0215 g Sb/ml. 256 ml of this Sn/Sb/HCl solution was then added to the slurry over a period of 2 hours simultaneously with sufficient 10% NaOH to maintain the pH of the slurry at 2.0. The slurry was digested for a half-hour at pH=2.0 and at a temperature of 90° C., and then the resulting particles were filtered, washed to remove soluble salts, and dried overnight at a temperature of 120° C. The dried particles, which comprised a powder, were then calcined in air at 750° for 2 hours. 106 g of dry powder were recovered. The finished powder product had a dry powder resistivity of 5 ohms. By X-ray fluorescence analysis, the powder was found to contain 46% Sn (as $SnO_2$), 22% Si (as $SiO_2$), 18% Ba (as BaO), and 4% Sb (as $Sb_2O_3$). This powder, when examined under the electron microscope, was found to consist of hollow shells of silica with fine crystallites of antimony-doped tin oxide forming a uniform, two-dimensional network on the surface of the silica. The powder was formulated with a test paint carrier at a pigment/binder loading of 25/100 and applied to a test surface. The resulting dry paint film exhibited a surface conductivity of 140 Ransburg units.

EXAMPLE 2

(A) In an 18-liter, agitated polyethylene beaker, 3 liters of water were brought to a pH of 10.0 with NaOH. A stock solution of potassium silicate was obtained having a $SiO_2/K_2O$ molar ratio of 3.29 and containing 26.5% $SiO_2$ by weight. 100 g of this stock solution were added to the solution in the 18-liter beaker, and, thereafter, 1350 g of precipitated $CaCO_3$ powder, with a surface area of 4 $m^2/g$, were added to form a slurry. The slurry was heated to 90° C. in one-half hour by the introduction of steam, after which the pH was 9.7. Next, 3875 g of the above potassium silicate stock solution were diluted with 1000 ml of water and added to the slurry over a period of 5 hours. The pH was maintained at 9.0 during the addition by the simultaneous addition of hydrochloric acid. 262 g of 37% HCl, diluted to 1000 ml with water, were required to maintain the pH at 9.0. The slurry was then digested at 90° C. for one-half hour, after which the pH of the slurry was adjusted to a value of 7.0 by the addition of hydrochloric acid, and the resulting silica-coated particles were isolated by filtration, washed to remove soluble salts, and dried at 120° C. for 24 hours. 1607 g of powder were recovered.

(B) In a 3-liter, agitated glass flask, 250 g of powder prepared in (A) above were dispersed in 1 liter of water, and the resulting slurry was heated to a temperature of 90° C. 355 ml of nominal 37% HCl were then added to the slurry to adjust the pH to 2.0 and to dissolve the core material. Next, an aqueous solution of $SnCl_4$, $SbCl_3$ and HCl was prepared by combining 158 ml of an aqueous $SnCl_4$ solution containing the equivalent of 0.286 g $SnO_2$/ml, with 20 ml of an aqueous HCl solution of $SbCl_3$, containing the equivalent of 0.235 g Sb/ml. This solution was added to the slurry over a period of 2 hours, simultaneously with sufficient 10% NaOH to maintain the pH of the slurry at 2.0. The slurry was digested at a temperature of 90° C. and pH of 2.0 for one-half hour, and then the resulting particles were filtered, washed with water to remove soluble salts, and calcined at 750° C. for 2 hours. The finished powder product had a dry powder resistance of 18 ohms. When analyzed by X-ray fluorescence, the powder was found to contain 48% Sn (as $SnO_2$), 47% Si (as $SiO_2$), 6% Sb (as $Sb_2O_3$), and 0.3% Ca (as CaO). When examined under the electron microscope, the powder was found to consist of hollow shells of silica and of fragments of shells of silica, with fine crystallites of antimony-doped tin oxide forming a uniform, two-dimensional network on the surface of the silica. By transmission electron microscope, the average antimony-doped tin oxide crystallite size was found to be 9 nm. By X-ray diffraction line broadening, the crystallite size was 8 nm. The powder had a surface area, by nitrogen adsorption, of 50 $m^2/g$ and an average pore size of 7.7 nm. The powder had a specific gravity of 3.83 g/cc and a bulk density of 0.317 g/cc.

25.9 g of a high solids polyester/melamine/castor oil resin and 12.3 g of the dry powder of this example were added to a 4 oz. glass jar to form a mill base. The jar was sealed and shaken for 5 minutes on a paint shaker. 8.5 g of butanol/xylene/diisobutyl ketone solvent and 160 g of 20–30 mesh zirconia beads were added to the jar, and it was shaken for an additional 10 minutes. The zirconia beads were then removed by screening, and 22.8 g of mill base were recovered. A 9.7 g sample of this mill base was then diluted with 7.6 g of resin to give a slurry having a pigment (dry powder)/binder ratio of 15/100.

0.06 g of catalyst (Cycat 600, a dodecylbenzenesulfonic acid catalyst in a dimethyl oxazoladine solvent) were added and the slurry was stirred. A slurry, i.e., paint, film was then cast on a glass plate using a draw-down blade with a 0.015 mil gap. The film was cured by heating to 163° C. for one-half hour. The resulting cured film had a Ransburg reading of 158.

A repeat of the procedure using 10.8 g of the mill base diluted with 4.4 g of binder to give a pigment/binder ratio 20 was also done. 0.05 g of catalyst were added, and a film was prepared as described above. The resulting cured film had a conductivity which exceeded the maximum Ransburg reading of 165 units.

The filtrate, obtained when the coated powder was filtered from the reaction slurry, was analyzed for Sn and Sb by inductively coupled plasma spectra and found to contain less than 1 part per million (the detection limit of the method) of each element.

18 g of the conductive powder, prepared above, were mixed with 77.7 g of a commercial vinyl acrylic latex paint and 6 g of water. The ingredients were first mixed together manually and then mixed in a commercial paint shaker for 10 minutes, using 160 g of 20–30 mesh zirconia beads. The resulting paint was drawn down on commercial corrugated cardboard at a thickness of approximately 2 mils. After drying the painted surface had a Randsburg reading of over 120 unites.

EXAMPLE 3

(A) In an 18-liter, agitated polyethylene beaker, 3 liters of water were brought to a pH of 10.0 with NaOH. 100 g of potassium silicate (26.5% $SiO_2$) were added to form a solution. Thereafter, 1350 g of $CaCO_3$, which had previously been dispersed in 1 liter of water, were added. The slurry was heated to 90° C. in one-half hour by the introduction of steam, after which the pH was 9.9. Next, 1027 g of potassium silicate solution (26.5% $SiO_2$), predispersed in 1 liter of water, and 262 ml of nominal 37% HCl, diluted to 1 liter with water, were added simultaneously to the slurry over a period of 5 hours. The pH was maintained at 9.0 during the addition of the two solutions. The slurry was then digested at 90° C. for one-half hour, the pH was adjusted to 7.0 with hydrochloric acid, and, after sedimentation, the supernatant was decanted and the resulting mixture reheated to 90° C.

(B) Next, nominal 37% HCl was added until the pH reached 2.0. 1016 ml of an aqueous $SnCl_4$ solution containing the equivalent of 0.286 g $SnO_2$/ml, and 129 ml of an $SbCl_3$/HCl solution, containing the equivalent of 0.235 g Sb/ml were combined and added to the slurry over a period of 2 hours simultaneously with sufficient 30% NaOH to maintain the pH of the slurry at 2.0. The slurry was digested at a temperature of 90° C. for one-half hour, and the resulting particles were filtered, washed with water to remove soluble salts, and then calcined at a temperature of 750° C. for 2 hours. The finished powder product had a dry powder resistance of 3 ohms. By X-ray fluorescence analysis, the powder was found to contain 46% Sn (as $SnO_2$), 47% Si (as $SiO_2$), 6% Sb (as $Sb_2O_3$) and 0.2% Ca (as CaO).

EXAMPLE 4

(A) In an 18-liter, polyethylene beaker, 3 liters of water were brought to a pH of 10.0 with NaOH. 90 g of sodium silicate, in the form of the stock solution of Example 1, were added to form a solution and, thereafter, 1350 g of calcined $BaCO_3$, with a surface area of 2.3 $m^2/g$, were added. The slurry was heated to 90° C. in one-half hour, after which the pH was 9.7. Next, 343 ml of the sodium silicate stock solution of Example 1 were diluted to 600 ml with water and added to the slurry over a period of one-half hour. Then 143 ml of nominal 37% HCl, diluted to 600 ml with water, were added to the slurry over a period of 3 hours, until the pH reached 7.0. The slurry was then digested at a temperature of 90° C. for one-half hour at a pH of 7.0. Next, after sedimentation, the supernatant was decanted, and the remaining mixture was reheated to 90° C.

(B) Nominal 37% HCl was then added until the pH of the reaction mass reached 2.0. Next, 909 ml of an $SnCl_4$ solution were prepared which contained the equivalent of 0.286 g $SnO_2$/ml, and 111 ml of an $SbCl_3$ solution were prepared which contained the equivalent of 0.235 g Sb/ml, and these solutions were mixed together and added to the slurry over a period of 2 hours, while simultaneously adding 30% NaOH to maintain the pH at a value of 2.0. The slurry was digested for one-half hour at a temperature of 90° C. and a pH of 2.0. The resulting particles were then filtered, washed with water to remove soluble salts, and calcined at a temperature of 750° C. for 2 hours. The finished powder had a dry powder resistance of 4 ohms. 480 g of powder were recovered. By X-ray fluorescence analysis, the powder was found to contain 54.2% Sn (as $SnO_2$), 33.8% Si (as $SiC_2$), 6.4% Sb (as $Sb_2O_3$), and 4.6% Ba (as BaO).

EXAMPLE 5

(A) In an 18-liter, polyethylene beaker, 3 liters of water were brought to a pH of 10.0 with sodium hydroxide. 100 g of the potassium silicate stock solution of Example 2 were added, followed by 1350 g of barium carbonate powder, with a surface area of 2.3 $m^2/g$. The slurry was heated to 90° C. in one-half hour, at which time the pH was 9.0. 515 g of the potassium silicate stock solution were diluted to 600 ml with water and added to the agitated slurry over a period of one-half hour. 139 ml of nominal 37% HCl were diluted to 600 ml with water, and added to the agitated slurry over a period of 3 hours, at which time the pH had dropped to 7. The slurry was held at 90° C. and a pH of 7 for one-half hour. The product was then filtered, washed free of soluble salts, and dried at 120° C. 1498 g of powder were recovered.

(B) 250 g of the powder prepared in (A) above was dispersed in 1 liter of water by mixing in a high speed blender for 2 minutes. The slurry was heated to 90° C. and nominal 37% HCl was added until the pH had dropped to 2. 185 ml of the nominal 37% HCl were required. A $SnCl_4$/$SbCl_3$/HCl stock solution was prepared as in Example 1, but containing the equivalent of 0.254 g of $SnO_2$/ml and 0.064 g Sb/ml of solution. 178 ml of this solution was added to the stirred slurry over a period of 3 hours, along with sufficient 10% NaOH to maintain the pH at 2. The slurry was then held at 90° C. and a pH of 2 for an additional one-half hour. The product was filtered, washed free of soluble salts, and dried at 120° C. and calcined in air at 750° C. for 2 hours. 79 g of powder were recovered. This powder had a dry powder resistance of 22 ohms. It had a surface area, by nitrogen adsorption, of 49.8 $m^2/g$ and an average pore diameter of 9.4 nm. When examined under the electron microscope, the product was found to consist of hollow shells of silica with fine crystallites of antimony-doped tin oxide forming a uniform, two-dimensional network on the surface of the silica. By transmission electron microscopy, the average crystallite size was 10 nm. By X-ray diffraction line broadening, the average crystallite size was 8 nm. By X-ray fluorescence analysis, the powder contained 57% Sn (as $SnO_2$), 34% Si (as $SiO_2$), 7% Sb (as $Sb_2O_3$), and 1.3% Ba (as BaO). the powder had a specific gravity of 4.31 g/cc and a tapped bulk density of 0.333 g/cc. The powder had an isoelectric point of 2.3.

EXAMPLE 6

(A) In an agitated, 18-liter polyethylene beaker, 3000 g of 97% pure rutile titania powder, with a 6.8 $m^2/g$ surface area, were dispersed in 6 liters of water. The pH was brought to 10.0 with NaOH. 454 ml of the sodium silicate stock solution of Example 1 were added to the agitated slurry. The slurry was heated to 90° C. in one-half hour by the direct introduction of steam. Then, 10% sulfuric acid was added gradually over a period of 2 hours, until a pH of 7 was reached. The slurry was then held at 90° C. and a pH of 7 for an additional one-half-hour, and the resulting silica-coated titania particles were isolated by filtration, washed to remove soluble salts, and dried overnight at a temperature of 120° C. 3108 g of powder were recovered.

(B) 100 g of the powder prepared in (A) above was dispersed in one liter of water, using a high speed mixer. The slurry was transferred to an agitated, 3-liter glass flask and 200 g of barium carbonate powder were added. The slurry was then heated to 90° C. and the pH was adjusted to 2.0 by the addition of hydrochloric acid. Then, 197 ml of a $SnCl_4$/$SbCl_3$/HCl solution were added to the slurry over a period of 2 hours, while maintaining the pH at 2.0 by the simultaneous addition of a 10% NaOH solution. The $SnCl_4$/$SbCl_3$/HCl solution contained the equivalent of 0.254 g $SnO_2$/ml, 0.0262 g Sb/ml and was prepared as in Example 1. The slurry was held an additional one-half-hour at 90° C. and pH 2.0, after completion of the simultaneous additions. The resulting particles were filtered, washed to remove soluble salts, and dried overnight at a temperature of 120° C. The powder was then calcined in air at 600° C. for 2 hours. 155 g of powder were recovered. The dry powder resistivity was 3 ohms. By X-ray fluorescence analysis, the powder contained 32% Sn (as $SnO_2$), 4% Si (as $SiO_2$), 4% Sb (as $Sb_2O_3$), and 60% Ti (as $TiO_2$). Examination of the powder under the electron microscope revealed that the titania particles were coated with silica, and that the silica surface was coated with fine crystallites of tin oxide. The crystallites of antimony-containing tin oxide were uniformly dispersed as a two-dimensional network on the silica surfaces. The isoelectric point of this powder was determined to be 3.1. The surface area, by nitrogen adsorption, was 15.4 $m^2/g$ and the average pore diameter was 9 nm. By X-ray diffraction line broadening, the tin oxide crystallite size was determined to be 15 nm. By transmission electron microscope, the average antimony-doped tin oxide crystallite size was determined to be 9 nm. The finished product had a dry powder resistance of 3.2 ohms.

30 grams of the calcined powder were then incorporated into 70 grams of low density polyethylene by blending and extruding through a Banbury mill. The polyethylene resin had a melting point of 105°–107° C., and the mixture was bended in the mill for 2 minutes at 110°–120° C. at 230 rpm. The mixture was extruded at a ram pressure of 50–60 psi, and the extruded blend was pressed into sheets of 10 mil thickness. The sheets had a specific conductance of 0.68 ohm-cm.

Example 6 was repeated without the addition of $BaCO_3$ in part B, and the dry powder resistance increased to 166 ohms.

Examination of the powder under the electron microscope showed less complete development of the two-dimensional network of tin oxide crystallites on the silica surface. The isoelectric point of this powder was 5.0, and the surface area was 20.4 $m^2/g$. The $SnO_2$ crystallite size, by X-ray line broadening, was 11 nm.

Example 6 was repeated, but with both the silica coating and the $BaCO_3$ eliminated from the procedure. The dry powder resistance of the resulting powder was 3000 ohms, and examination of the powder under the electron microscope showed incomplete development of a surface nextwork of tin oxide crystallites. Much of the tin oxide appeared to have entered into a solid solution with the titania.

EXAMPLE 7

(A) In an agitated, 18-liter polyethylene beaker, 3000 g of barium sulfate (Blanc Fixe), with a surface area of 3.3 $m^2/g$, were dispersed in 6 liters of water. The pH was adjusted to 10.0 with sodium hydroxide, and 454 ml of the stock sodium silicate solution from Example 1 were added. The slurry was heated to 90° C. in one-half hour by the introduction of dteam. Then, 10% sulfuric acid was added at the rate of 100 ml/hr until the pH reached 7.0. The particles were filtered, washed to remove soluble salts, and dried overnight at 120° C. 3130 g of dry powder were recovered.

(B) In an 18-liter, agitated polyethylene beaker, 500 g of the powder prepared in (A) above the 500 g of $CaCO_3$ were dispersed in 5000 ml of water. The slurry was heated to 90° C. and the pH adjusted to 2.0 with hydrochloric acid. 325 ml of a $SnCl_4/SbCl_3/HCl$ solution were then added to the slurry over a period of 2 hours, while maintaining the pH at 2.0 by the simultaneous addition of a 10% solution of NaOH. The temperature was maintained at 90° C. throughout this addition. The $SnCl_4/SbCl_3/HCl$ solution was prepared as in Example 1 and contained the equivalent of 83 g $SnO_2$ and 8.3 g of Sb. The slurry was held at 90° C. and a pH of 2.0 for an additional half-hour. The product was then filtered, washed to remove soluble salts, dried overnight at 120° C. and calcined in air at 750° C. for 2 hours. 557 g of product were recovered, having a dry powder resistance of 12 ohms. By X-ray fluorescence analysis, the powder contained 14% Sn (as $SnO_2$), 2% Sb (as $Sb_2O_3$), 5% Si (as $SiO_2$) and 79% Ba (as $BaSO_4$).

The Example was repeated without the addition of calcium carbonate, and the dry powder resistivity was 1200 ohms. The Example was again repeated without either the silica coating or the calcium carbonate addition, and the dry powder resistance increased to 1400 ohms.

EXAMPLE 8

2 liters of deionized water were placed in a 3-liter beaker and heated to 90° C. 25 g of $CaCl_2$ were added to the bath. Over a period of 2 hours, 400 g of potassium silicate solution, with a $SiO_2/K_2O$ molar ratio of 3.29/1 and containing 24% $SiO_2$ by weight, were added to the solution while maintaining the pH at 9.5 with nominal 37% HCl. Good agitation was maintained during the silica precipitation. Following the addition of the potassium silicate solution, the pH was adjusted to 7.0 with HCl and held for one-half hour. The pH was then lowered to 2.0 with concentrated HCl. A solution of $SnCl_4/SbCl_3$ was prepared as follows: 2000 g of $SnCl_4.5H_2O$ were dissolved in water and adjusted to a total volume of 3000 ml. 250 g of $SbCl_3$ were dissolved in 500 ml of nominal 37% HCl. For the stock solution, 600 ml of the $SnCl_4$ solution, along with 73 ml of the $SbCl_3$ solution, were mixed together. The stock solution was added to the calcium modified silica slurry over a 2 hour period, while maintaining the slurry at a pH of 2.0 by the addition of 20% NaOH. The temperature was maintained at 90° C. After a half-hour cure, the product was isolated by filtering and washed free of soluble salts. The product was then dried for 12 hours at 120° C. The dried product was then calcined in a silica dish at 750° C. for 2 hours. 296 g of dry powder were recovered. The surface area of the dried product was 80 $m^2/g$, and the surface area of the calcined product was 48 $m^2/g$. The calcined powder had a dry resistance of 6 ohms. The powder composition, reported as oxides, was 55% $SnO_2$, 7% $Sb_2O_3$, 37% $SiO_2$, and 0.3% CaO. When examined under the electron microscope, the powder was found to consist of particles of silica with fine tin oxide crystallites dispersed in a continuous two-dimensional network on the surface of the silica. The powder had an isoelectric point of 2.3.

When the above Example was repeated without the calcium chloride, the dry powder resistance was 8 ohms. The calcined powder had a surface area of 60 $m^2/g$.

EXAMPLE 9

2 liters of deionized water were placed in a 3-liter beaker and heated to 90° C. 15 g of $Ba(OH)_2.H_2O$ were added to the heated water. Over a period of 2 hours, 400 g of the potassium silicate solution of Example 8 were added to the solution while maintaining the pH at 9.5 with nominal 37% HCl. Good agitation was maintained during the silica precipitation. Following the addition of the potassium silicate solution, the pH was adjusted to 7.0 and held for one-half hour. The pH was then lowered to 2.0 with nominal 37% HCl. A stock solution of $SnCl_4/SbCl_3$ was prepared as follows: 2000 g of $SnCl_4.5H_2O$ were dissolved in water and adjusted to a total volume of 3000 ml with deionized water. 250 g of $SbCl_3$ were dissolved in 500 ml of nominal 37% HCl. 600 ml of the $SnCl_4$ solution and 73 ml of the $SbCl_3$ solution were mixed together for the stock solution for addition to the precipitated silica. The stock solution was added over a 2 hour period at a pH of 2 and 90° C., using a 20% NaOH solution to control the pH. After a half-hour cure, the product was isolated by filtering and washed free of soluble salts. The product was dried for 12 hours at 120° C. The dried product was calcined in air in a silica dish at 750° C. for 2 hours. 295 g of the dry powder were recovered. The surface area of the dried product was 83 $m^2/g$, and the surface area of the calcined product was 39 $m^2/g$. The powder composition, reported as oxides, was 58% $SnO_2$, 7% $Sb_2O_3$, 35% $SiO_2$, and 0.4% BaO. The powder had an isoelectric point of 2.0.

This Example was repeated without the presence of silica or barium by simply adding the $SnCl_4/SbCl_3/HCl$ stock solution to water at 90° C., while maintaining the pH at 2.0 by the addition of NaOH. The resulting dry powder had an isoelectric point of 0.5.

EXAMPLE 10

(A) 3000 ml of deionized water was placed in a 5-liter beaker equipped with a paddle stirrer. Th pH was adjusted to 10.5 with a 20% NaOH solution, and the temperature of the mixture was raised to 75° C. using a hot plate. Separately, a stock coating solution was prepared by mixing together 615 g of potassium silicate solution (24% $SiO_2$) with 200 g of $Na_2B_2O_4.8H_2O$. 150 g of the stock coating solution were added to the stirred solution in the 5-liter beaker over a period of 2 minutes. Immediately following the addition of the stock coating solution, 1350 g of $BaCO_3$ powder was added over about a 2 minute period. The remainder of the stock coating solution (665 g) was then added to the slurry. Over a period 3 hours, while maintaining a temperature of 75° C., a total of 1660 ml of 6N HCl were added to the stirred slurry. When the HCl addition was completed, the slurry was held at pH 7 and 75° C. for one-half hour. The $SiO_2/B_2O_3$ coated $BaCO_3$ was isolated by filtering with a coarse sintered glass filter. The product was washed with deionized water to 7000 micromhos and then dried 12 hours at 120° C. The product contained 12% $SiO_2/B_2O_3$.

(B) 250 g of the $BaCO_3$ powder, coated with 12% $SiO_2/B_2O_3$ as prepared in (A) above, were placed in a Waring blender with 500 ml of deionized water and blended for 2 minutes. The material was added to 1300 ml of water in a 4-liter beaker equipped with a paddle stirrer. The slurry was heated to 60° C. and nominal 37% HCl was added dropwise to the stirred slurry to remove the $BaCO_3$ core. 187 ml of nominal 37% HCl were required. The pH stabilized at 2.0 when all the available $BaCO_3$ had been removed. A stock solution of $SnCl_4/SbCl_3$ was added to the slurry at pH 2.0, over a period of 2 hours. The pH was maintained at 2.0 by simultaneously adding a 20% solution of NaOH. The product was then filtered and washed to 7000 micromhos. The washed product was dried for 12 hours at 120° C., and calcined in air for 2 hours at 750° C. 84 g of dry powder were recovered. In the dry powder cell, the product had a resistance of 8 ohms. The product had a surface area of 128.9 $m^2/g$.

EXAMPLE 11

(A) 300 g of barium sulfate (Blanc Fix) were dispersed in one liter of water in a 3-liter agitated glass flask and heated to 90° C. Over a period of 2 hours, 197 ml of an $SnCl_4/SbCl_3/HCl$ solution, containing the equivalent of 50 g of $SnO_2$ and 5.0 of Sb, and prepared according to the procedure of Example 1, was added to the slurry. When the pH reached 2, 10% sodium hydroxide was added along with the $SnCl_4/SbCl_3/HCl$ solution to maintain the pH at 2 for the remainder of the addition. The slurry was then held an additional one-half hour at a pH of 2 and at a temperature of 90° C. The product was filtered, washed free of soluble salts, and calcined in air at 750° C. for 2 hours. 354 g of dry product were recovered.

(B) Part (A) was repeated, except that 333 g of $CaCl_2$ were dissolved in the one liter used to form the $BaSO_4$ slurry. 354 g of dry product were recovered.

(C) 3000 g of $BaSO_4$ were dispersed in 6 liters of water in an 18-liter agitated polyethylene beaker. The pH was adjusted to 10.0 by the addition of 10% NaOH. 628 g of a sodium silicate solution, containing 28.7% $SiO_2$ and 8.9% $Na_2O$ were added, and the slurry was then heated to 90° C. in one-half hour. The pH was then 10.15. A 25% $H_2SO_4$ solution was then added at a rate of 100 ml/hour until the pH reached 7.0. The slurry was held at pH 7 and 90° C. for one-half hour. The resulting product was filtered, washed free of soluble salts, and dried overnight at 120° C. 3088 g of dry powder were recovered.

(D) In a 3-liter agitated glass flask, 300 g of the powder from step (C) above were dispersed in one liter of water and then heated to 90° C. Over a period of 2 hours, 197 ml of the $SnCl_4/SbCl_3/HCl$ solution of Part (A) were added to the slurry. When the pH dropped to 2.0, sufficient 10% caustic was added along with the $SnCl_4/SbCl_3/HCl$ solution to maintain the pH at 2, and the temperature was maintained at 90° C. The resulting product was filtered, washed free of soluble salts, and then calcined in air for 2 hours at a temperature of 750° C. 356 g of dry powder were recovered.

(E) Part (D) was repeated, except that 333 g of $CaCl_2$ were dissolved in the one liter of water used to form the slurry. 154 g of dry powder were recovered.

Dry powder resistances, pore diameters and surface areas for the powders produced in steps (A), (B), (C), and (D) were measured, and the results are shown in Table 2.

TABLE 2

| Part | $SiO_2$ | $CaCl_2$ | Resistance | Pore Diameter nm | Surface Area, $m^2/g$ |
|---|---|---|---|---|---|
| (A) | No | No | 200 ohms | 12.0 | 8.4 |
| (B) | No | Yes | 60 ohms | 9.9 | 7.6 |
| (C) | Yes | No | 75 ohms | 11.5 | 11.4 |
| (D) | Yes | Yes | 2 ohms | 7.5 | 9.2 |

TABLE 3

| Part | % B as $BaSO_4$ | % Sn as $SnO_2$ | % Si as $SiO_2$ | % Sb as $Sb_2O_3$ | % Ca as CaO |
|---|---|---|---|---|---|
| (A) | 83 | 14 | 0 | 1.7 | <0.05 |
| (B) | 83 | 14 | 0 | 1.7 | <0.05 |
| (C) | 79 | 14 | 6.5 | 1.7 | <0.05 |
| (D) | 79 | 14 | 6.4 | 1.6 | <0.05 |

EXAMPLE 12

(A) 188 g of wet-ground Muscovite mica, with a surface area of 8.7 $m^2/g$, was dispersed with 0.8% of triethanolamine in 2000 ml of distilled water. The process temperature was raised to 90° C. and held there for the remainder of the aqueous processing. The pH was adjusted to 10.0 with 20% NaOH, and 50 g of 3.29 ratio potassium silicate (25% (25% $SiO_2$) was added to the stirred slurry over two minutes. 20% HCl was then added to the slurry over a 2 hour period, bringing the pH to 8.0. The pH was then further adjusted to 7.0 with 20% HCl, and the slurry was stirred for 30 minutes. The pH was then adjusted to 2.0 with 20% HCl, and 220 g of $CaCl_2$ were added to the bath over a five minute period. 220 ml of a $SnCl_4$ solution (0.445 g $SnO_2$/ml) and 42 ml of a $SbCl_3$ solution (0.235 g Sb/ml) were mixed together and added to the slurry over 2 hours, maintaining the pH at 2.0 by the addition of 20% NaOH. The slurry was held at 90° C. and a pH of 2 for 30 minutes. It was then filtered, washed free of soluble salts and dried at 120° C. for 12 hours. The dried product was calcined at 75° C. for 2 hours. By X-ray fluorescence analysis, the powder was found to contain 33.1% Sn (as $SnO_2$), 4.0% Sb (as $Sb_2O_3$), 31.2% Si (as $SiO_2$), 22.0% Al (as $Al_2O_3$), and 6.3% K (as $K_2O$). By X-ray diffraction line broadening, the average $SnO_2$ crystallite size was 7 nm. A polyester/melamine/castor oil primer paint was prepared as in Example 2.

(B) The procedure of Part (A) was repeated, except that the silica coating was eliminated. After dispersing the mica in water and triethanolamine, the pH was lowered to 2.0 by the addition of 20% HCl. The calcium chloride was added, and the Part (A) procedure was followed from that point on.

(C) The procedure of Part (A) was repeated, except that the calcium chloride solution was not used.

The composition and electroconductive performance of the resulting powders were found to be as follows. The compositions were determined by X-ray fluorescence analysis, and the crystallite size was determined by X-ray diffraction line broadening.

TABLE 4

| Powder | % $SnO_2$ | % $Sb_2O_3$ | % $SiO_2$ | % $Al_2O_3$ | ppm CaO | % $K_2O$ |
|---|---|---|---|---|---|---|
| A | 33.1 | 4.0 | 31.2 | 22.0 | 100 | 6.3 |
| B | 33.8 | 4.2 | 28.9 | 22.6 | 100 | 6.3 |
| C | 33.5 | 3.6 | 33.6 | 23.3 | 100 | 6.3 |

| | Crystallite Size | Performance in Paint | |
|---|---|---|---|
| Powder | of $SnO_2$—Sb nm | P/B | Conductivity, Ransburg Units |
| A | 7 | 48 | over 165 |
| | | 25 | 145 |
| B | 8 | 48 | 140 |
| | | 25 | 75 |
| C | 8 | 48 | 90 |
| | | 25 | 75 |

EXAMPLE 13

Example 12, Part (A) was repeated, except that 188 g of delaminated Kaolinite clay were substituted for the 188 g of mica, the amount of $SnCl_4$ solution was increased to 252 ml, and the amount of $SbCl_3$ solution was increased to 48 ml. The Kaolinite had a surface area of 12.7 $m^2/g$. A sample of the powder was incorporated into a polyester/melamine/castor oil paint as in Example 2. The resulting paint film had a conductivity of 135 Ransburg units at a P/B of 50.

I claim:

1. An electroconductive composition which comprises a core material having an amorphous silica coating or a silica-containing coating and an electrically conducting network of antimony-containing tin oxide in which the antimony content ranges from 1 to about 30% by weight of the tin oxide.

2. The composition of claim 1 in which the shaped particles have an aspect ratio of at least 2.

3. The composition of claims 1 or 2 in which the silica-containing material is a composition selected from metal silicates, silica-containing glass, and material having an extensive co-valent network involving $SiO_4$ units.

4. The composition of claims 1 or 3 in which the silica-containing material is a silica-boria material.

5. The composition of claim 1 in which the core consists essentially of barium sulfate.

6. The composition of claim 1 in which the core consists essentially of titanium dioxide.

7. An electroconductive composition as in claim 1 wherein the electrically conducting tin oxide contains up to about 10% by weight of one or more grain refiners selected from alkali metals, alkaline earth metals, transition metals and rare earth elements.

8. The composition of claim 7 in which the grain refiners are selected from Ca, Ba, Sr, and Mg.

9. The composition of claim 1 in which the silica-containing material is mica.

10. The composition of claim 1 in which the coating of amorphous silica or silica-containing coating is less than 20 nm and the conducting network, comprises antimony-containing tin oxide crystallites less than about 20 nm.

11. In a polymeric carrier matrix, an electroconductive network comprising interconnecting shaped particles, said particles comprising an inert core material having a coating of silica or a silica-containing material and a coating of a two-dimensional conducting network of antimony-containing tin oxide crystallites in which the antimony is present in an amount of from 1 to about 30% by weight of the tin oxide.

12. The electroconductive network of claim 11 or claim 8 in which the polymeric carrier matrix is a film of paint.

13. The electroconductive network of claim 11 or claim 8 in which the polymeric carrier matrix is a fiber.

14. In a polymeric carrier matrix, an electroconductive network comprising interconnecting shaped particles, said particles having a structure consisting essentially of a substrate of amorphous silica or a silica-containing material with a coating comprising electrically conductive antimony-containing tin oxide in which the antimony content ranges from 1 to about 30% by weight of the tin oxide.

15. The composition of claim 14 in which the substrate consists essentially of mica.

16. An electroconductive composition which is a powder comprising shaped particles selected from $BaSO_4$, $SrSO_4$, $CaSO_4$, graphite, carbon, mica, and $TiO_2$ which are coated with a two-dimensional conducting network of antimony-containing tin oxide crystallites, said coating containing at least about 100 parts per million of a grain refiner or mixture of grain refiners selected from alkali metals, alkaline earth metals, transition metals, or rare earth elements.

17. The composition of claim 16 in which the shaped particle is $BaSO_4$ and the grain refiner is Ca.

18. An electroconductive composition wherein said composition comprises hollow silica shells less than about 250 nm in thickness that have an exterior coating comprising electrically conductive antominy-containing tin oxide in which the antimony content ranges from 1 to about 30% by weight of the tin oxide, wherein said exterior coating optionally comprises up to about 10% by weight of at least one grain refiner selected from alkali metals, alkaline earth metals, transition metals and rare earth elements.

19. An electroconductive composition wherein said composition comprises particles, said particles comprising a core material having at least two coatings wherein one of said coatings is silica or a silica-containing material and wherein one of said coatings comprises electrically conductive antimony-containing tin oxide in which the antimony content ranges from about 1 to about 30% by weight of the tin oxide.

* * * * *